United States Patent [19]

Higby et al.

[11] Patent Number: 4,870,705

[45] Date of Patent: Oct. 3, 1989

[54] NECK ROLL APPARATUS AND METHOD

[75] Inventors: Edwin A. Higby, Cedar City; G. Weston Meier; Breck D. Fife, both of Salt Lake City, all of Utah

[73] Assignee: Fife Meier, Inc., Salt Lake City, Utah

[21] Appl. No.: 190,572

[22] Filed: May 5, 1988

[51] Int. Cl.[4] ..... A41D 13/00

[52] U.S. Cl. ..... 2/2

[58] Field of Search ..... 2/2, 415

[56] References Cited

U.S. PATENT DOCUMENTS

| | | | |
|---|---|---|---|
| 3,189,917 | 6/1965 | Sims | 2/415 |
| 3,497,872 | 3/1970 | Mitchell | 2/2 |
| 3,855,631 | 12/1974 | Ettinger | 2/2 |
| 4,338,685 | 7/1982 | LaPorta | 2/2 |
| 4,449,251 | 5/1984 | Gauthier | 2/2 |
| 4,501,023 | 2/1985 | Bilberry | 2/44 |
| 4,590,622 | 5/1986 | Wolfe et al. | 2/2 |
| 4,686,710 | 8/1987 | Marston et al. | 2/2 |

*Primary Examiner*—Ronald Feldbaum

*Attorney, Agent, or Firm*—J. Winslow Young

[57] ABSTRACT

A neck protective device to be worn by sports participants and including a neck roll held against the back of the neck by a pair of straps passing along each side of the neck. The straps are joined at their distal ends in a tab and include grommets to adapt the straps to being laced to other protective equipment worn by the sports participant.

10 Claims, 2 Drawing Sheets

NECK ROLL APPARATUS AND METHOD

BACKGROUND

1. Field of the Invention

This invention relates to protective equipment for sports participants and, more particularly, to a neck roll apparatus and method for protecting a sports participant against neck injuries.

2. The Prior Art

Football is a popular contact sport both for participants and spectators and is engaged in by various age groups and organizations. As a sport, football involves vigorous bodily contact so that each participant wears extensive protective equipment so as to reduce, to the extent possible, bodily injury. This protective equipment ranges between fitted helmets with face guards to special shoes. The protective equipment is designed to protect the body from injuries resulting from direct impact during the game. However, numerous injuries result from the force of impact being transmitted through the protective equipment to another part of the body, for example, by causing movement in a direction for which the body is not prepared. Serious knee, shoulder, arm, and neck injuries are sustained as a result of these kinds of forces.

Neck injuries are particularly dangerous because of the serious consequence to the player. Many neck injuries result from an impact to the head (although protected by a helmet) which forces the neck backwardly beyond its normal range of motion. This type of injury is particularly prevalent among football players who are designated as linemen and who plunge headfirst into the opposing linemen at the line of scrimmage. Typically, the helmet and shoulder pads absorb most of the forces received by the player but, on unfortunate occasions, the player's head/helmet is forced sharply backward beyond the normal range of motion of the neck causing injury to the player's neck.

In view of the foregoing it would be an advancement in the art to provide a protective device to reduce neck injuries. An even further advancement in the art would be to provide a neck roll which can be worn by the football player, the neck roll providing a cushion for the back of the neck to reduce injuries by restricting the backwardly oriented range of motion of the neck. Such a novel device and method is disclosed and claimed herein.

BRIEF SUMMARY AND OBJECTS OF THE INVENTION

This invention relates to a novel neck roll apparatus and method for protecting the neck of a sports participant by reducing the tendency for injury from forces which tend to force the neck backwardly beyond its normal range of motion. The neck roll is designed as a resilient roll of material worn across the back of the neck and is held in place by straps that pass on each side of the neck and are joined adjacent the middle of the torso. The ends of the straps are joined at a point above the navel of the player and include grommets which adapt the straps to being releasably laced to a shoulder pad assembly.

It is, therefore, a primary object of this invention to provide improvements in neck protective apparatus.

It is another object of this invention to provide improvements in the method for protecting the neck of a sports participant against injury by supplying the sports participant with a neck roll.

Another object of this invention is to provide a neck roll having straps extending therefrom, the straps passing on each side of the neck of the wearer and holding the neck roll in place across the back of the neck of the wearer.

Another object of this invention is to provide a neck roll apparatus having neck roll segments on each end of the neck roll, the neck roll segments providing protection against forces that are received at an angle from the front.

These and other objects and features of the present invention will become more readily apparent from the following description and appended claims taken in conjunction with the accompanying drawing.

DETAILED DESCRIPTION OF THE PREFERRED EMBODIMENTS

Figure 1:
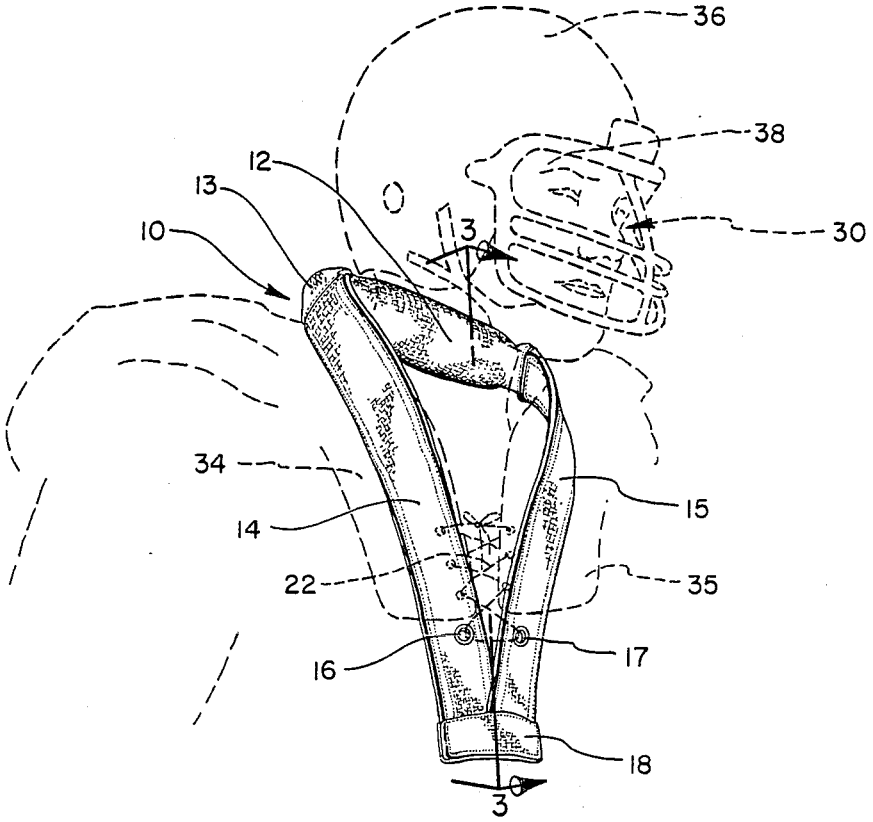
FIG. 1 is a perspective, frontal view of a first preferred embodiment of the neck roll of this invention shown in the environment of a football player (shown in broken lines)

The invention is best understood from the following description and appended claims with reference to the drawing wherein like parts are designated with like numerals throughout.

Figure 2:
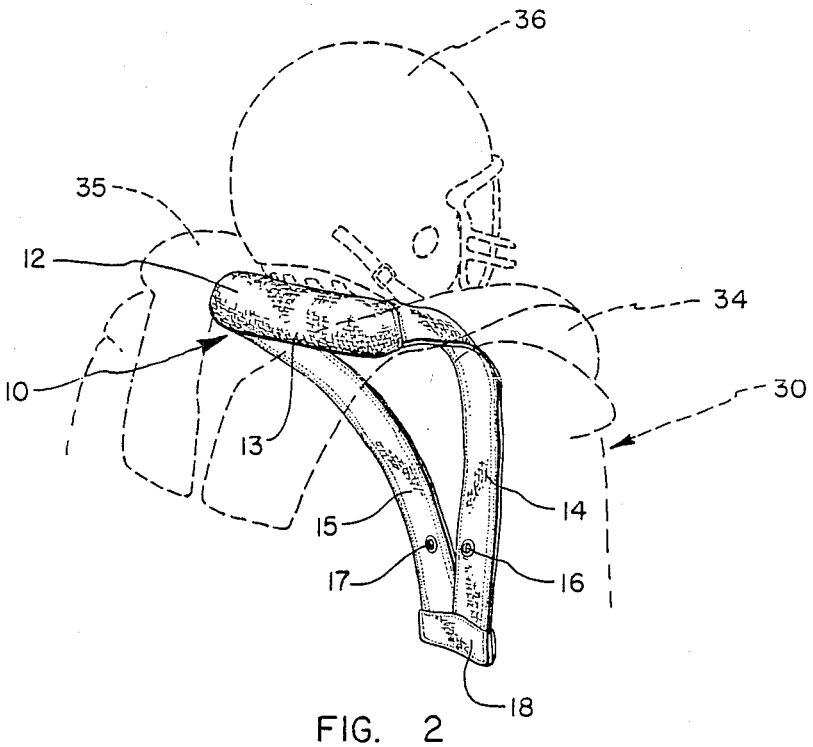
FIG. 2 is a perspective, rear view of the neck roll of FIG. 1 also shown in the environment of a football player (shown in broken lines)
Figure 3:
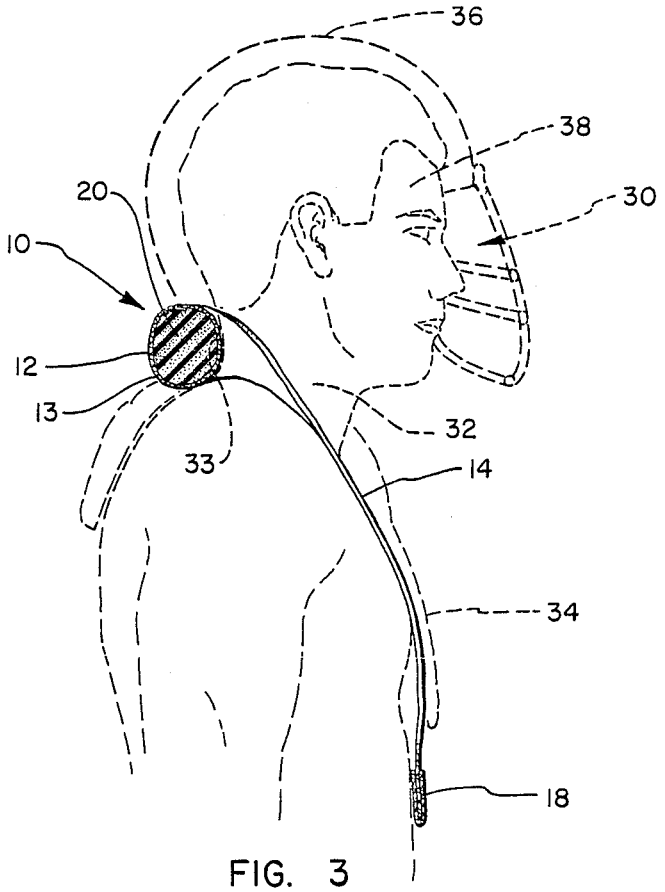
FIG. 3 is a partial cross sectional view taken along lines 3—3 of FIG. 1.

Referring now to FIGS. 1–3, the novel neck roll apparatus of this invention is shown generally at 10 in the environment of a football player 30 (shown in broken lines) and includes a neck roll 12 with straps 14 and 15 extending from each end. It will be noted that the novel neck roll apparatus 10 and method of this invention is described in detail in relation to a football player 30 although it is to be clearly understood that it could also provide beneficial results if worn by sports participants in other vigorous contact sports such as ice hockey. Neck roll 12 is formed as a cylindrical member from suitably resilient materials such as synthetic sponge material 20 (FIG. 3) and covered with an appropriate fabric 13. The length and diameter of neck roll 12 is selectively predetermined to provide the desired degree of support to neck 32 against backwardly oriented bending forces imposed thereon. Clearly, different sizes of players 30 will benefit from different sizes of neck roll 12. Synthetic foam 20 may be of a suitable material such as a synthetic rubber polyurethane, or the like, as long as it resists deterioration from perspiration and can be suitably cleaned. The fabric cover 13 (FIG. 3) is selected from a fabric that is smooth and soft to the touch and may be provided in any desired color or color combinations.

Straps 14 and 15 are secured to fabric 13 at each end of neck roll 12 and are adapted to pass along each side of neck 32 of football player 30 to hold neck roll 12 in position against the back 33 of the neck 32 (FIG. 3). The ends of straps 14 and 15 are secured together in a tab 18. Straps 14 and 15 are provided with sufficient length so as to terminate in tab 18 at a point slightly above the navel (not shown) of football player 30. This placement of tab 18 means that it is readily accessible to football player 30 so that it can be grasped through the jersey (not shown) and pulled downwardly to seat neck roll 12 snugly against back 33 of neck 32.

Grommets 16 and 17 are placed in straps 14 and 15, respectively, and readily adapt straps 14 and 15 to being releasably secured to the respective shoulder pads 34 and 35 of football player 30. Grommets 16 and 17 can include a plurality of spaced grommets to facilitate adjustably securing straps 14 and 15 to shoulder pads 34 and 35. In operation, football player 30 passes lacing 22 through grommets 16 and 17 during the normal lacing operation for shoulder pads 34 and 35 thereby easily securing straps 14 and 15 to the respective shoulder pads 34 and 35 without requiring any change or modification of the existing shoulder pad equipment.

Neck roll 12 rests against back 33 of neck 32 so that collision forces encountered by helmet 36 and which bend head 38 backwardly are cushioned by the resilience of synthetic foam 20 (FIG. 3) in neck roll 12 thereby reducing injury to neck 32.

Figure 4:
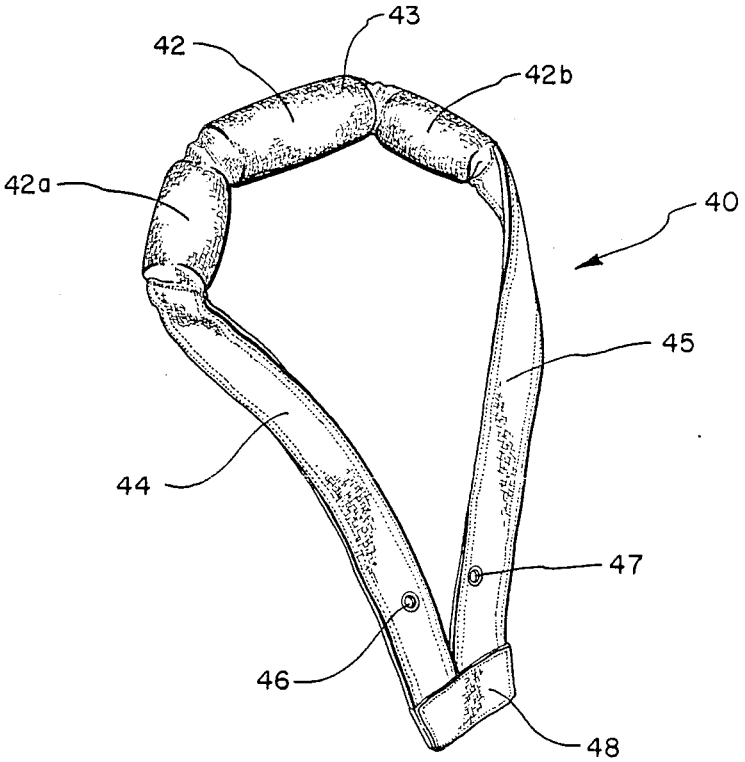
FIG. 4 is a perspective view of a second preferred embodiment of the neck roll o this invention.

Referring also to FIG. 4, a second preferred embodiment of the neck roll apparatus of this invention is shown generally at 40 and includes a neck roll 42 having extensions 42*a* and 42*b* extending from each end, all of which are covered with a fabric 43. Straps 44 and 45 extend from extensions 42*a* and 42*b*, respectively, and are joined in a tab 48. Grommets 46 and 47 in straps 44 and 45, respectively, adapt neck roll apparatus 40 to being releasably secured to shoulder pads 34 and 35 (FIGS. 1–3) as previously described with regard to neck roll apparatus 10.

Neck rolls 12 and 42 are each fabricated from a length of synthetic foam material, the synthetic foam material having sufficient density and resiliency to adequately perform in its role of protecting the neck 32 against backwardly directed or even whiplash-type forces imposed against helmet 36/head 38. The length of neck rolls 12 and 42 is sufficient to provide a suitable protection across the back of neck 32 and may include extensions 42*a* and 42*b* (FIG. 4) which extend transversely along a portion of both sides of neck 32. Extensions 42*a* and 42*b* provide protection against backward bending forces imposed against neck 32 at a direction other than a front-to-back direction.

The diameter and cross sectional profile of neck rolls 12 and 42 are selectively predetermined to provide maximum protection of neck 32 and without adversely interfering with the performance of football player 30. Currently, a circular cross sectional profile is supplied although it is anticipated that a noncircular or even an elliptical cross sectional profile could be advantageously utilized in this invention. Importantly, the length, size, and shape of neck rolls 12 and 42 along with extensions 42*a* and 42*b* are predetermined so as to provide maximal protection to neck 32 of football player 30.

Fabrics 13 and 43 are obtained from a suitably soft, smooth fabric so as to reduce irritation to neck 32 since neck rolls 12 and 42 are both designed to be worn snugly against the back of neck 32 in order to provide maximal protection to neck 32. Fabrics 13 and 43 may also be provided with any preselected color so as to designate school colors, position played by football player 30, or even include an advertising logo, if applicable, to designate a particular sponsor for either football player 30 or his team. Further fabrics 13 and 43 can be selectively resilient or have a limited capability to be stretched so as to accommodate conformance of neck rolls 12 and 42 when the same are compressed or otherwise deformed during usage.

Straps 14 and 15 as well as straps 44 and 45 (FIG. 4) are fabricated from a canvas-like fabric so as to provide the necessary strength characteristics to neck roll apparatus 10 and 40, respectively. This canvas-like material also provides sufficient weight to assist in retaining neck roll 12 against the back of neck 32. Further, the relative stiffness of this canvas-like material means that straps 14 and 15 as well a straps 44 and 45 will lie flat against the chest of football player 30 without undue twisting or the like.

The relative stiffness of the canvas-like fabric of straps 14 and 15 as well as straps 44 and 45 holds the respective tabs 18 and 48 at the generally desired position above the navel (not shown) of football player 30. This means that football player 30 13 can readily readjust the positioning of neck roll apparatus 10 and 40 by the simple expedient of grasping tab 18 or 48 and pulling downwardly thereon. Further, the respective grommets 16, 17, 46, and 47 allow football player 30 to lace the respective neck roll apparatus 10 or 40 to the shoulder pads 34 and 35 so that pulling downwardly on tabs 18 and 48 selectively repositions shoulder pads 34 and 35.

THE METHOD

A suitable quantity as synthetic foam material 20 (FIG. 3) having a preselected resiliency and a predetermined size and shape to create neck rolls 12 and 42 is selectively encased in suitable fabrics 13 and 43. Extensions 42*a* and 42*b* may also be attached to the ends thereof and encased in fabric 43. Straps 14 and 15 as well as straps 44 and 45, respectively, are mounted to the ends thereof and joined at their distal ends in tabs 18 and 48. Grommets 16, 17, 46, and 47, respectively, are placed in straps 14, 15, 44, and 45 to provide the desired degree of anchorage with shoulder pads 34 and 35. Additional grommets (not shown) may be included, as desired.

Football player 30 places shoulder pads 34 and 35 upon his shoulders on each side of neck 32 and then places neckroll 12 or 42 across back 33 of neck 32 with straps 14 and 15 or 44 and 45 on each side of neck 32 in juxtaposition with shoulder pads 34 and 35. During the lacing operation of shoulder pads 34 and 35 lacing 22 is also passed through grommets 16 and 17 or grommets 46 and 47 at the predetermined position relative to shoulder pads 34 and 35, respectively, to thereby selectively preposition straps 14 and 15 or straps 44 and 45 to the shoulder pads. Once adjusted according to this technique, neck roll 12 or neck roll 42, as well as shoulder pads 34 and 35, may be readily repositioned by the simple expedient of grasping tab 18 or tab 48 and pulling the same downwardly.

During use, neck roll 12 or neck roll 42 resides against back 33 of neck 32 so that whiplash-type forces imposed against helmet 36 and head 38 and which are thereby transmitted to neck 32 are absorbed by the resilient foam material 20 thereby protecting neck 32 against being forced backwardly beyond its normal limit of backward curvature.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A neck protective apparatus to be worn by a sports participant as a neck protection device during sporting activities comprising:

a generally cylindrical neck roll having a diameter sufficient to provide cushioning protection to the neck upon backward movement of the head, said neck roll having a length generally corresponding to the distance across the back of said neck;

a first strap of fabric attached to a first end of said neck roll and being adapted to pass around a first side of said neck and having a first length sufficient to reach a position generally adjacent the navel of said sports participant;

a second strap of fabric attached to a second end of said neck roll and being adapted to pass around a second side of said neck and having a second length corresponding to said first length; and hand grasping means for hand grasping said first strap and said second strap for pulling downwardly on a said first strap and said second strap to reposition said neck roll against the back of said neck, said hand grasping means comprising a tab joining the end of said first strap to the end of said second strap so as to place said tab in a position adjacent said navel when said neck protective apparatus is worn by said sports participant.

2. The neck protective apparatus defined in claim 1 wherein said neck roll is fabricated from a resilient material.

3. The neck protective apparatus defined in claim 1 wherein said neck roll includes a first extension on said first end and a second extension on said second end, said first and second extension forming a protective neck roll extension around said back of said neck.

4. The neck protective apparatus defined in claim wherein said first strap includes a first grommet means and a second strap includes a second grommet means, said first and second grommet means comprising tie down means for securement of said neck protective apparatus.

5. The neck protective apparatus defined in claim 1 wherein said neck roll comprises a synthetic sponge material having a predetermined degree of resiliency and is covered with a first fabric, said first fabric connecting said first and second straps to said neck roll, said first and second straps being fabricated from a second fabric.

6. A neck roll apparatus for protecting the neck of a sports participant against backwardly bending forces imposed upon the neck comprising:

a neck roll fabricated from a resilient material and having a length and a diameter to provide protection against backward bending of the neck when worn against the back of the neck;

a first fabric covering the neck roll, the first fabric having a smooth, soft texture;

a first strap and a second strap attached to the first fabric at each end of the neck roll, the first and second straps being fabricated from a second fabric and being configured to pass along each side of the neck and to be against the chest of the sports participant;

hand grasping means for hand grasping said first strap and said second strap for pulling downwardly on said first strap and said second strap to reposition said neck roll against the back of said neck, said hand grasping means comprising a tab joining the distal ends of the first and second straps; and grommets in the first and second straps to adapt the first and second straps to securement to a third object.

7. The neck roll apparatus defined in claim 6 wherein the neck roll includes extensions on each end to extend the neck roll to a portion of the sides of the neck.

8. A method of protecting the neck of a sports participant against excessive backward curvature of the neck comprising:

obtaining a resilient material and forming the resilient material into a neck roll to reside across the back of the neck of the sports participant;

encasing the resilient material in a first fabric;

preparing a pair of straps from a second material and attaching a strap to the first fabric at each end of the neck roll;

joining the distal ends of the straps in a tab;

placing the neck roll against the back of the neck of the sports participant and holding the neck roll in place by laying the straps along each side of the neck and against the chest of the sports participant; and reseating the neck roll against the back of the neck of the sports participant by pulling downwardly on the tab.

9. The method defined in claim 8 wherein the placing step further comprises releasably securing the straps to protective equipment worn by the sports participant by forming grommets in the straps and lacing the grommets to the protective equipment.

10. The method defined in claim 8 wherein the obtaining step further comprises forming extensions on the ends of the neck roll thereby providing additional protection to the neck of the sports participant, the extensions extending an incremental distance along the side of the neck.

* * * * *